US011534648B2

(12) United States Patent
McBrayer

(10) Patent No.: US 11,534,648 B2
(45) Date of Patent: Dec. 27, 2022

(54) ALL-IN-ONE MULTIPURPOSE RESISTANCE BAND BASED PORTABLE STRENGTH TRAINING DEVICE

(71) Applicant: EVO Fitness, LLC., Lithia Springs, GA (US)

(72) Inventor: Mitchell McBrayer, Lithia Springs, GA (US)

( * ) Notice: Subject to any disclaimer, the term of this patent is extended or adjusted under 35 U.S.C. 154(b) by 16 days.

(21) Appl. No.: 17/237,423

(22) Filed: Apr. 22, 2021

(65) Prior Publication Data

US 2022/0339484 A1 Oct. 27, 2022

(51) Int. Cl.
*A63B 21/055* (2006.01)
*A63B 21/00* (2006.01)
*A63B 21/04* (2006.01)

(52) U.S. Cl.
CPC ..... *A63B 21/0557* (2013.01); *A63B 21/0442* (2013.01); *A63B 21/4033* (2015.10); *A63B 2210/50* (2013.01)

(58) Field of Classification Search
CPC ..... A63B 21/0557; A63B 21/0442; A63B 21/4033; A63B 2210/50
See application file for complete search history.

(56) References Cited

U.S. PATENT DOCUMENTS 6,402,670 B1 * 6/2002 Anagnostou ..... A63B 21/068 482/148
6,994,634 B1 * 2/2006 McFarlin ..... A63B 69/3661 473/278
8,715,144 B1 * 5/2014 Friess ..... A63B 21/4033 482/121
8,905,902 B2 * 12/2014 Burcham ..... A63B 21/151 482/142
9,259,606 B2 * 2/2016 Wolan ..... A63B 21/0442
10,512,814 B1 * 12/2019 Conroy ..... A63B 21/00069
10,610,728 B2 * 4/2020 Fano ..... A63B 21/0557
10,744,361 B2 * 8/2020 Duval ..... A63B 21/4037
10,953,260 B2 * 3/2021 Weisz ..... A63B 21/0557
2007/0087920 A1 * 4/2007 Dachraoui ..... A63B 21/0552 482/121
2007/0155526 A1 * 7/2007 McFarlin ..... A63B 69/3661 473/278
2013/0090216 A1 * 4/2013 Jackson ..... A63B 21/0442 482/52
2014/0221178 A1 * 8/2014 Wagner ..... A63B 23/12 482/126
2016/0199682 A1 * 7/2016 Borak ..... A63B 71/0054 482/122
2017/0080273 A1 * 3/2017 Sanchez Gonzalez ..... A63B 23/0355

(Continued)

FOREIGN PATENT DOCUMENTS

WO WO-2007104509 A1 * 9/2007 ..... A63B 21/04

*Primary Examiner* — Andrew S Lo
(74) *Attorney, Agent, or Firm* — Alexander Postnikov

(57) ABSTRACT

The present invention is directed at a novel portable fitness device used for conducting strength training exercises. The device comprises a foldable frame that can hold exercise accessories inside the device while the device is folded. The device further comprises an anti-slide plate and anchor slots wherein at least one resistance band can be locked into the anchor slots. The resistance bands may connect to handles or a bar and the resistance bands may offer up to 300 pounds of resistance. The foldable frame doubles as a carrying case.

3 Claims, 9 Drawing Sheets

(56) References Cited

U.S. PATENT DOCUMENTS

| | | | | |
|---|---|---|---|---|
| 2018/0117396 | A1* | 5/2018 | Engelfried, Jr. ... | A63B 23/0405 |
| 2018/0236295 | A1* | 8/2018 | Oltorik ..... | A63B 21/4013 |
| 2020/0298054 | A1* | 9/2020 | Manion ..... | A63B 21/012 |
| 2021/0402248 | A1* | 12/2021 | Clark ..... | A63B 21/0442 |
| 2022/0001231 | A1* | 1/2022 | Fiducia ..... | A63B 21/4037 |

* cited by examiner

ALL-IN-ONE MULTIPURPOSE RESISTANCE BAND BASED PORTABLE STRENGTH TRAINING DEVICE

BACKGROUND

Field of Invention

The present disclosure relates to a portable fitness device, and, more particularly, to a platform with extending arms wherein resistance bands are attachable to the extending arms in order to conduct strength training exercises.

Description of Prior Art

This description of prior art includes information that may be useful in understanding the present invention. It is not an admission that any of the information provided herein is prior art or relevant to the presently claimed invention, or that any publication specifically or implicitly referenced is prior art.

It has long been recognized that regular exercise and stretching improves health and quality of life. Reduced stress, improved physical and mental wellbeing, injury prevention, reduced pain, increased strength and endurance, and the restoration of function are all clinically accepted benefits.

Although numerous portable devices exist for exercising, including portable devices for training, stretching, balancing, and therapy, a continued need exists for an exercise device having a broad spectrum of exercise applications, that is simple and safe to use, space efficient, relatively inexpensive, durable, portable, and more accessible to a wider range of individuals with the capability to exercise.

Conventionally used devices for resistance workouts are complicated and unwieldy. They lack the versatility to be integrated into most exercise programs. For example, some platforms are designed to only incorporate a user's body weight, thereby eliminating their potential use for a heavy lifter, while other platforms have bulky parts or bands that can only be incorporated into a limited number of workouts due to the limited options in the direction and intensity of resistances. Its apparent that there is a need for a versatile and lightweight exercise machine that can be incorporated into almost any exercise program.

SUMMARY

One embodiment of the present invention is directed at a portable and foldable fitness device. The fitness device has two frames that extend and resistance bands may be attached to the periphery of these frames in order to conduct strength training exercises.

The device includes a foldable platform having at least a first frame and at least a second frame. Each of the first frame and the second frame includes a top surface and a bottom surface. The foldable platform may be made of polycarbonate. The top surface has an anti-slide plate coupled thereto for providing slide resistance to a user. The anti-slide plate may be made of rubber. At least one anchor slot provided on each of the first frame and the second frame allows the locking of one or more resistance bands in the anchor slots to thereby change the intensity or location of the resistance a user would experience during exercise, allowing for almost a limitless number of exercises.

The fitness device enables the user to exercise using at least a portion of body weight for resistance while using at least one the first frame and the second frame for support. Each of the first frame and the second frame encloses an aluminum plate. Each of the first frame and the second frame are connected to each other through a hinge allows the angle between the bottom surface of the first frame and the bottom surface of the second frame to be adjusted between 0 and 180 degrees, allowing the fitness device to be folded and unfolded.

In its folded configuration, the fitness device has handholds that allow the foldable platform to double as a carrying case for the convenience of the user. The foldable platform has a locking mechanism that prevents the user from having to use his or her body weight to keep the first frame and the second frame from collapsing inward.

At least one anchor slot is provided on the periphery of each of the first frame and the second frame. Each of the one or more resistance bands has a plurality of small balls inserted inside at pre-determined intervals operating as protrusions to lock the resistance bands into at least one anchor slot. The protrusions allow the intensity and location of the resistance a user experiences during exercise to be adjusted, making it possible to perform deadlifts, overhead presses, or countless other exercises with the one or more resistance bands.

At least one of the resistance bands comprises a carabiner clip at one end. The device includes one or more removable handles connectable to each of the one or more resistance bands. At least one of the removable handles includes a plurality of sub-handles connectable to each other to form at least one handle from the one or more sub-handles.

The device includes one or more removable steel bars adapted to couple with the one or more resistance bands. The removable steel bars include a plurality of sub-bars that connect to each other to form at least one steel bar from the one or more sub-bars. Each of the one or more resistance bands comprise a hollow tube having one or more balls inserted at the pre-determined intervals, wherein an elastic cover encases the protrusion caused by the rubber ball and a surrounding portion of the hollow tube. The device includes a custom hook that can lock in up to four resistance bands and can be attached to a carabiner.

BRIEF SUMMARY OF DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, where.

DETAILED DESCRIPTION

The following detailed description is made with reference to the technology disclosed. Preferred implementations are described to illustrate the technology disclosed, not to limit its scope, which is defined by the claims. Those of ordinary skill in the art will recognize a variety of equivalent variations on the description.

Various terms as used herein are shown below. To the extent a term used in a claim is not defined below, it should be given the broadest definition persons in the pertinent art have given that term as reflected in printed publications and issued patents at the time of filing.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1A:
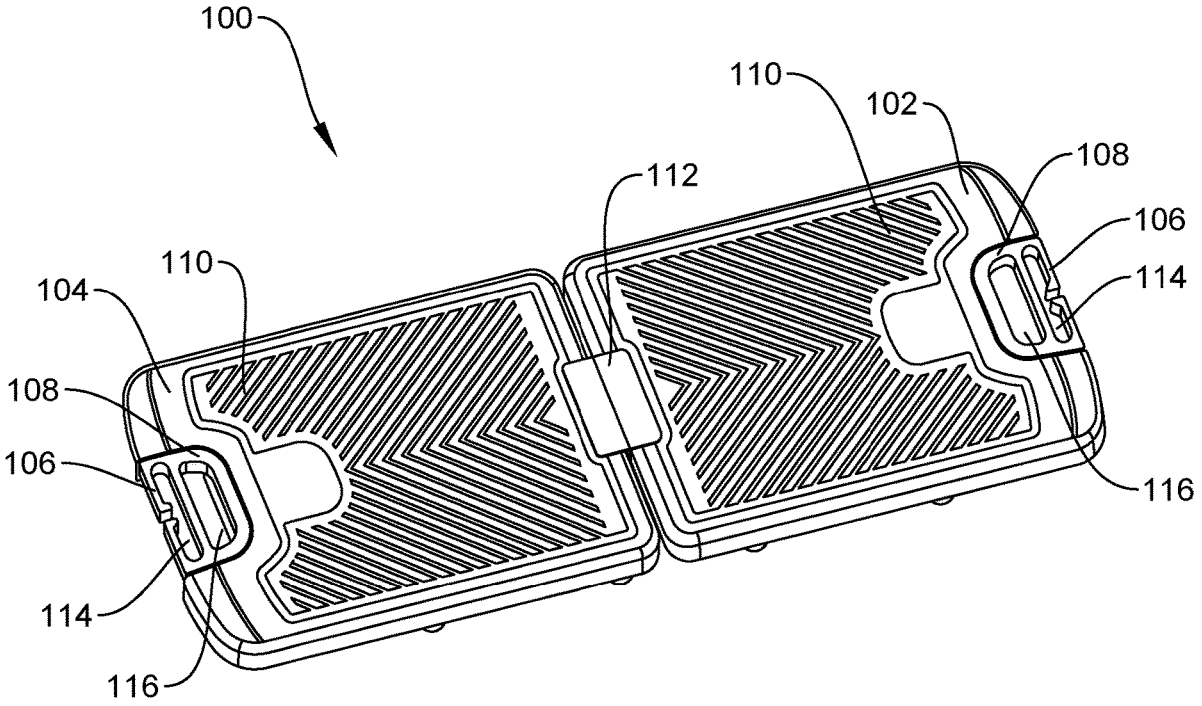
FIG. 1A illustrates a perspective view of one exemplary variation of the portable fitness device.
Figure 1B:
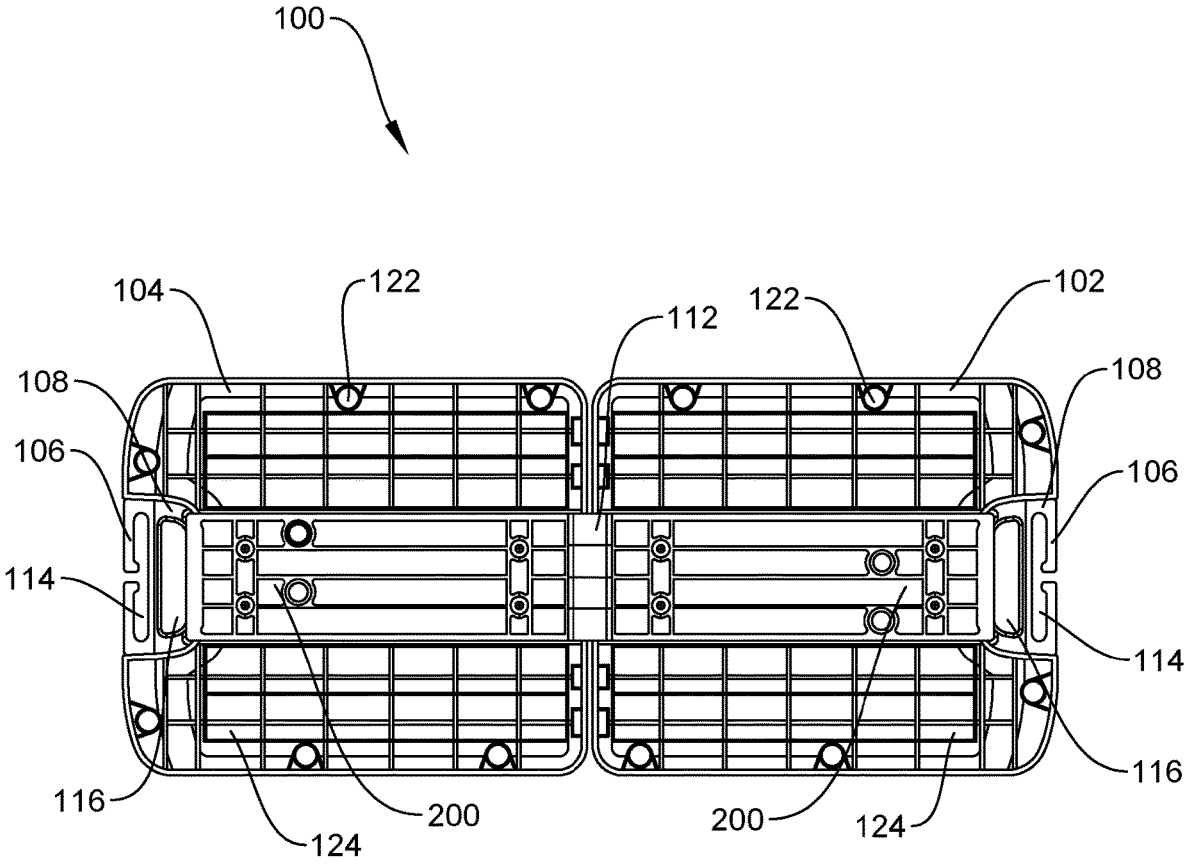
FIG. 1B illustrates a bottom view of one exemplary variation of the portable fitness device.

In FIG. 1A and FIG. 1B, one exemplary portable fitness device 100 is shown and described in detail. The portable fitness device 100 may comprise a first frame 102 and a second frame 104. The first frame 102 and the second frame 104 may be identical and may be generally square or rectangular. The first frame 102 and the second frame 104 may be made of a lightweight and rigid material, or a combination of lightweight and rigid materials, including, but not limited to, polycarbonate, carbon fiber, aluminum, plastics, or any other suitable material.

The first frame 102 and the second frame 104 may each have a top surface and a bottom surface. The first frame 102 and the second frame 104 may each have a plurality of leg holes 122 positioned at several points on the bottom surface. These leg holes may allow a rubber leg to be attached to the bottom surface of the first frame 102 and the second frame 104.

The first frame 102 and the second frame 104 may each have an anti-slide plate 110 attached to the top surface of the first frame 102 and the second frame 104. The anti-slide plate 110 may be attached to the top surface of the first frame 102 and the second frame 104 using screws, rivets, nuts and bolts, adhesives, or other common fastening methods. The anti-slide plate 100 may have a surface texture that improves grip. The anti-slide plate 100 may be made high-grip materials including, but not limited to, rubber.

The first frame 102 and the second frame 104 may each have a central cavity and each central cavity may have at least one screw hole positioned along the walls of the central cavity. The central cavity may approximately take up the central third portion of the first frame 102 and the second frame 104 and may run lengthwise from the hinge 112 area to the periphery of the first frame 102 and the second frame 104. The central cavity of the first frame 102 and the second frame 104 may house an aluminum plate 200. Each aluminum plate 200 may have at least one screw hole positioned corresponding to the screw hole or holes on each of central cavities of the first frame 102 and the second frame 104. Each aluminum plate 200 may be attached to the first frame 102 and the second frame 104 by screwing in a screw through any of the screw holes on the aluminum plate 200 and the corresponding screw holes on the first frame 102 or the second frame 104. In other variations, each aluminum plate 200 may be integrated into the first frame 102 and the second frame 104 or each aluminum plate 200 may be attached to the first frame 102 and the second frame 104 using rivets, nuts and bolts, adhesives, or other common fastening methods. In other variations, each aluminum plate 200 may made of a lightweight and rigid material, or a combination of lightweight and rigid materials, including, but not limited to, polycarbonate, carbon fiber, aluminum, plastics, or any other suitable material.

The first frame 102 and the second frame 104 may each have an outer cavity 124 or cavities 124 located on either side of the central cavity. These outer cavities 124 may appropriately be positioned lengthwise along the outer third portions of the first frame 102 and the second frame 104. The outer cavities 124 may be half-cylinder shaped wherein an outer cavity 124 of the first frame 102 may correspond to an outer cavity 124 of the second frame, wherein the corresponding outer cavities 124 combine to form a single cylinder-shaped cavity while the portable fitness device 100 is in the folded configuration, wherein this cylinder shaped cavity may hold steel bar sub-bars or other cylindrical exercise accessories, wherein these steel bar sub-bars are secured inside of the portable fitness device 100 while the portable fitness device 100 is in the folded configuration. In another variation, the outer cavities 124 may be shaped into a single large cavity or may comprise several smaller cavities, wherein the outer cavity or cavities hold at least one exercise accessory including, but not limited to, handles, resistance bands, custom hooks, carabiners, handle straps, and sub-bars, and wherein the exercise accessories are secured within the outer cavity 124 or cavities 124 of the first frame or the second frame 200 while the portable fitness device 100 is in the folded configuration.

Each aluminum plate 200 may have an inner portion, wherein the hinge piece 112 is positioned at the inner portion. Each aluminum plate 200 may have a peripheral section, wherein the handhold 108 and the anchor slot protrusions 106 are positioned at the peripheral section. Each handhold 108, may have a handhold opening 116. Each anchor slot protrusion 106 may enclose an anchor slot 114.

Each hinge piece 112 may have at least one opening through which a hinge pin can be inserted. One aluminum plate 200 may be connected to the other aluminum plate 200 by aligning the openings on the hinge piece 112 of one aluminum plate 200 with the openings on the hinge piece 112 of the other aluminum plate 200 and inserting a hinge pin through the hinge piece 112 openings, forming a hinge and securing the aluminum plates 200 together.

The portable fitness device 100 has an aluminum plate 200 attached to each of the first frame 102 and the second frame 104, and the hinge piece 112 of one aluminum plate 200 is secured to the hinge piece 112 of the other aluminum plate 200 using the hinge pin, allowing the first frame 102 and the second frame 104 to be rotated around the hinge, allowing the portable fitness device 100 to be folded and unfolded.

The portable fitness device 100 may have an unfolded configuration and a folded configuration. In the unfolded configuration, the bottom surface of the first frame 102 and the bottom surface of the second frame 104 are separated by 180 degrees and are parallel to each other. In the unfolded configuration, the bottom surface of the first frame 102 and the bottom surface of the second frame 104 are separated by 0 degrees and are flush. The portable fitness device 100 can be transformed between the unfolded configuration and the folded configuration by rotating the first frame 102 and the second frame 104 around the hinge, folding or unfolding the portable fitness device 100. When the portable fitness device 100 is in the folded configuration, the handhold 108 of the first frame 102 is flush with the handhold 108 of the second frame 104, forming a combined handhold. Users of the portable fitness device 100 may insert their fingers through the handhold openings 116 and may grip the handholds 108, allowing the portable fitness device 100 in the closed configuration to be carried by using the handholds 108.

The hinge 112 may have a mechanism that restricts rotation past 180 degrees, wherein an angle between the bottom surface of the first frame 102 and the bottom surface of the second frame 104 cannot exceed 180 degrees, preventing the foldable platform of the portable exercise device from collapsing inward. This mechanism may be built into the hinge pieces 112 in the form of metal plates on each of the hinge pieces 112, wherein these metal plates contact each other once the angle between the bottom surface of the first frame 102 and the bottom surface of the second frame 104 reaches 180 degrees, and wherein these metal plates prevent rotation of the bottom of the first frame 102 relative to the bottom of the second frame 104 past 180 degrees. In other variations, such metal plates may be positioned on the inside of the first frame 102 and the second frame.

Figure 2:
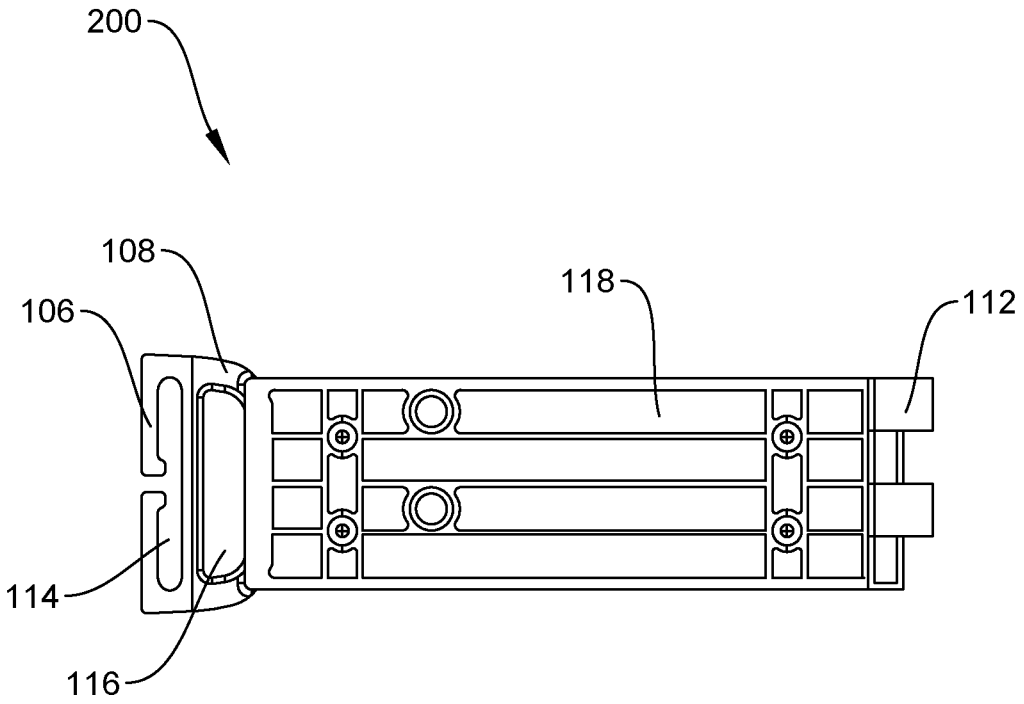
FIG. 2 illustrates a bottom view of one exemplary variation of the aluminum plate.

Referring now to FIG. 2, one exemplary aluminum plate 200 is shown and described in detail. The aluminum plate is identical to the aluminum plate 200 in FIG. 1A and FIG. 1B. The aluminum plate 200 may have at least one cavity 118, wherein the cavity 118 or cavities 118 hold at least one exercise accessory including, but not limited to, handles, resistance bands, custom hooks, carabiners, handle straps, and sub-bars, and wherein the exercise accessories are secured within the cavity 118 or cavities 118 of the aluminum plate 200 while the portable fitness device 100 is in the folded configuration.

Figure 3:
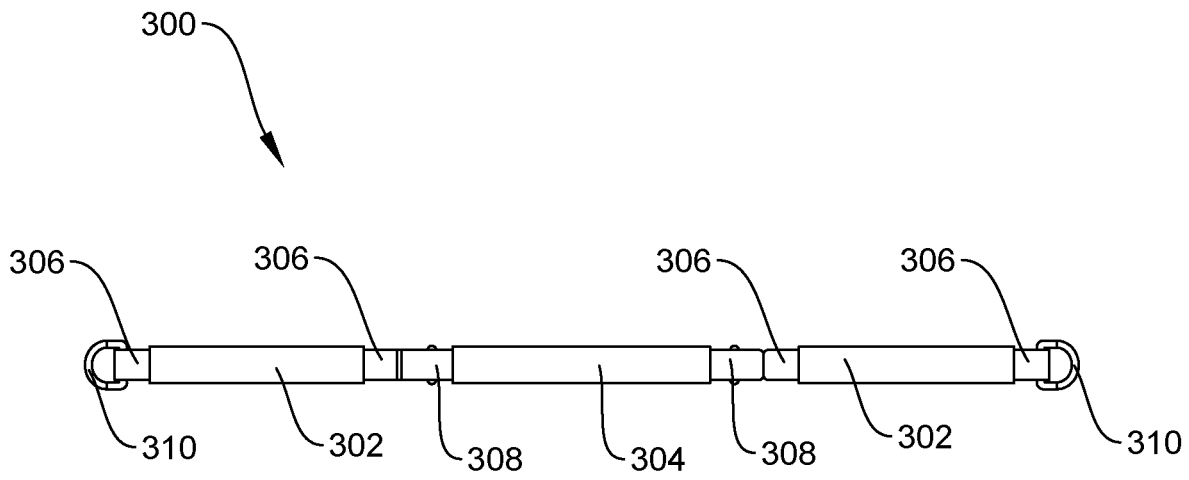
FIG. 3 illustrates a top view of one exemplary variation of the steel bar.

Referring now to FIG. 3, one exemplary steel bar 300 is shown and described in detail. The steel bar 300 may be comprised of sub-bars, wherein the sub-bars may be two shorter sub-bars 306 and one longer sub-bar 308. The shorter sub-bars 306 and the longer sub-bar 308 may be generally cylindrical and hollow. The shorter sub-bars 306 may have a circular top side at one end and a circular bottom side at the other end. The longer sub-bar 308 may have two identical circular sides at each end. The outer circumference of the top side of the shorter sub-bars 306 may be equal to or smaller in radius than the inner circumference of either one of the circular sides of the longer sub-bar 308, permitting the top side of the shorter sub-bars 308 to be inserted into either one of the circular sides of the longer sub-bar 308. The longer sub-bar 308 may have at least one hole located on both of the circular sides of the longer sub-bar 308. The shorter sub-bars 306 may have at least one hole located on the top side of the shorter sub-bars 308 and a spring mechanism that pushes a protrusion out of the hole or holes. This protrusion may protrude into at least one hole located on both of the circular sides of the longer sub-bar 308, locking the shorter sub-bars 306 into the longer sub-bar 308. In one variation, the shorter sub-bars 306 may have outer threading at the top side of the shorter sub-bars 306 and the longer sub-bar 308 may have inner threading at both of the circular ends, allowing the shorter sub-bars 306 to be screwed into the longer sub-bars 308, locking the shorter sub-bars 306 into the longer sub-bar 308. Alternatively, other common methods may be used to connect the shorter sub-bars 306 with the longer sub-bar 308.

The shorter sub-bars 306 may have at least one hole through the bottom side of the shorter sub-bars 306. This hole may hold the flat portion of a D-ring 310. The D-ring 310 may rotate freely around the axis formed between the two openings of the hole.

The middle section of the shorter sub-bars 306 may be encased by a shorter rubber handle 302. The shorter rubber handle 302 may provide increased grip, should not slide around during use, but should be removable. The middle section of the longer sub-bars 308 may be encased by a longer rubber handle 304.

Figure 4A:
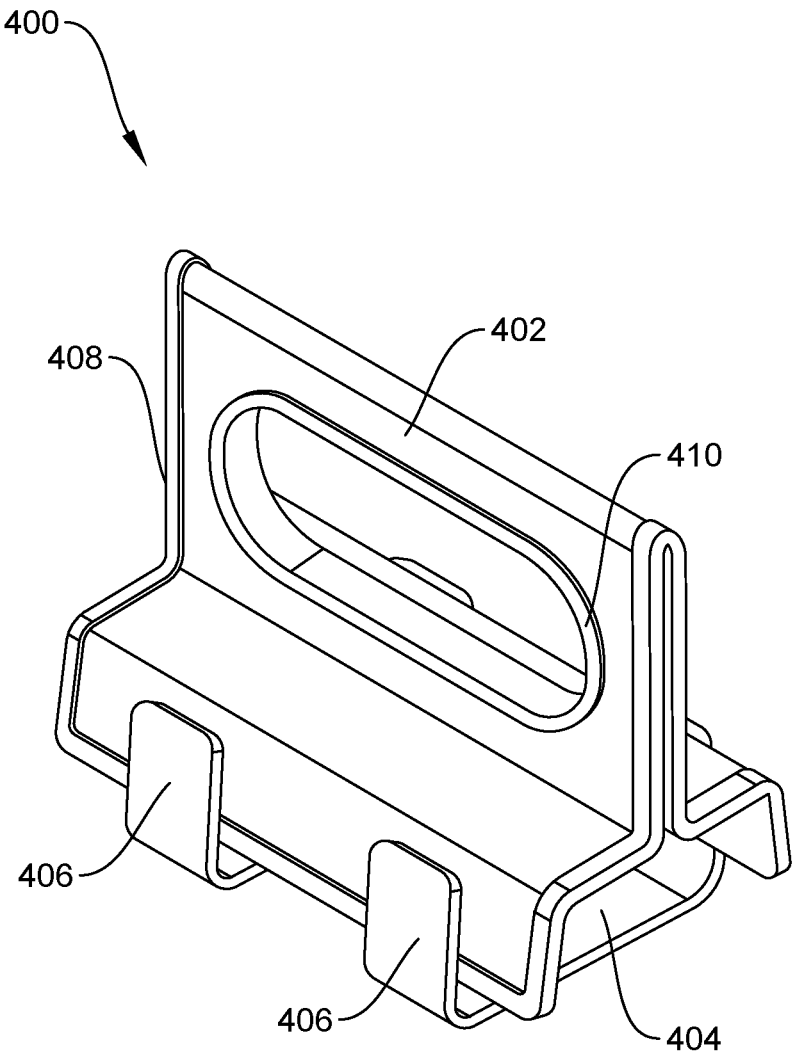
FIG. 4A illustrates a perspective view of one exemplary variation of the handle strap.

Referring now to FIG. 4A, one exemplary handle strap 400 is shown and described in detail. The handle strap 400 may comprise a main body 402 and at least one strap 404. The strap 404 may be permanently attached to the main body 402 at one end. The strap 404 may have an attachment point 406 at the other end of the strap 404. The strap 404 can be attached and detached from the main body 402 at the attachment point 406. The main body 402 may have an attachment point corresponding to the attachment point 406 of the strap 404. The attachment point 406 of the strap may be one part of a hook and loop fastener, a button hole, or any other common fastening method. The attachment point of the main body 402 may be the corresponding part of a hook and loop fastener, a button, or any other corresponding common fastening method.

The main body 402 and the strap 404 may be made of a durable fabric or a combination of durable fabrics. The main body 402 may have outer lining 408, wherein the outer lining 408 may be a soft material, including, but not limited to, rubber. The main body may have a handle-shaped opening, wherein the handle-shaped opening may have inner lining 410, and wherein the inner lining 410 may be a soft material, including, but not limited to, rubber.

Figure 4B:
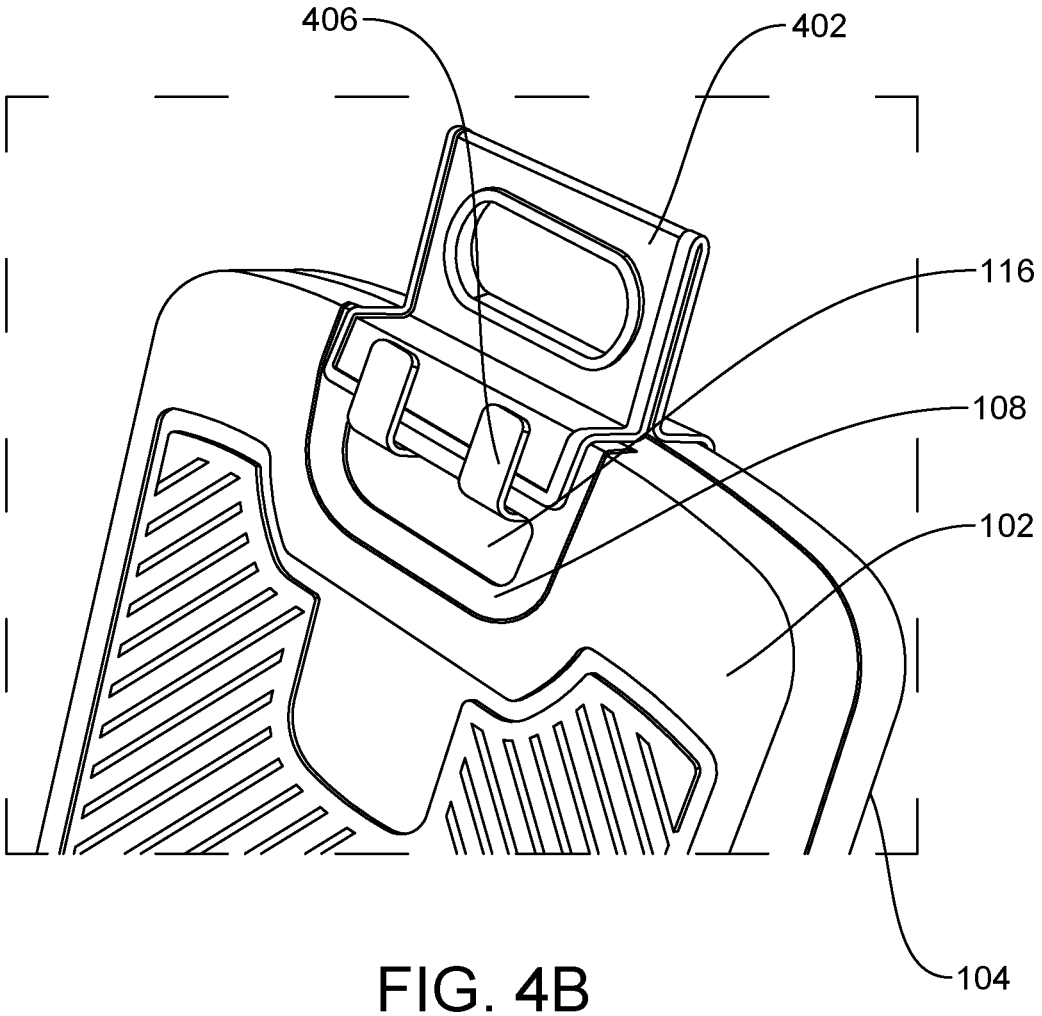
FIG. 4B illustrates a perspective view of one exemplary variation of the handle strap attached to the portable fitness device.

Referring now to FIG. 4B, one exemplary handle strap 400 attached to the portable fitness device in the folded configuration is shown and described in detail. The main body 402 may be positioned over the peripheral edges of the aluminum plates. The main body 402 may be slightly wider than the height of the portable fitness device in the folded configuration in order for part of the fabric of the main body to surround the peripheral edges of the aluminum plates. The strap 404 may be long enough to go through the handhold opening 116 and reattach to the main body 402. This handle strap 400, portable fitness device configuration allows the portable fitness device to be carried around using the handhold opening of the handle strap 400.

Figure 5:
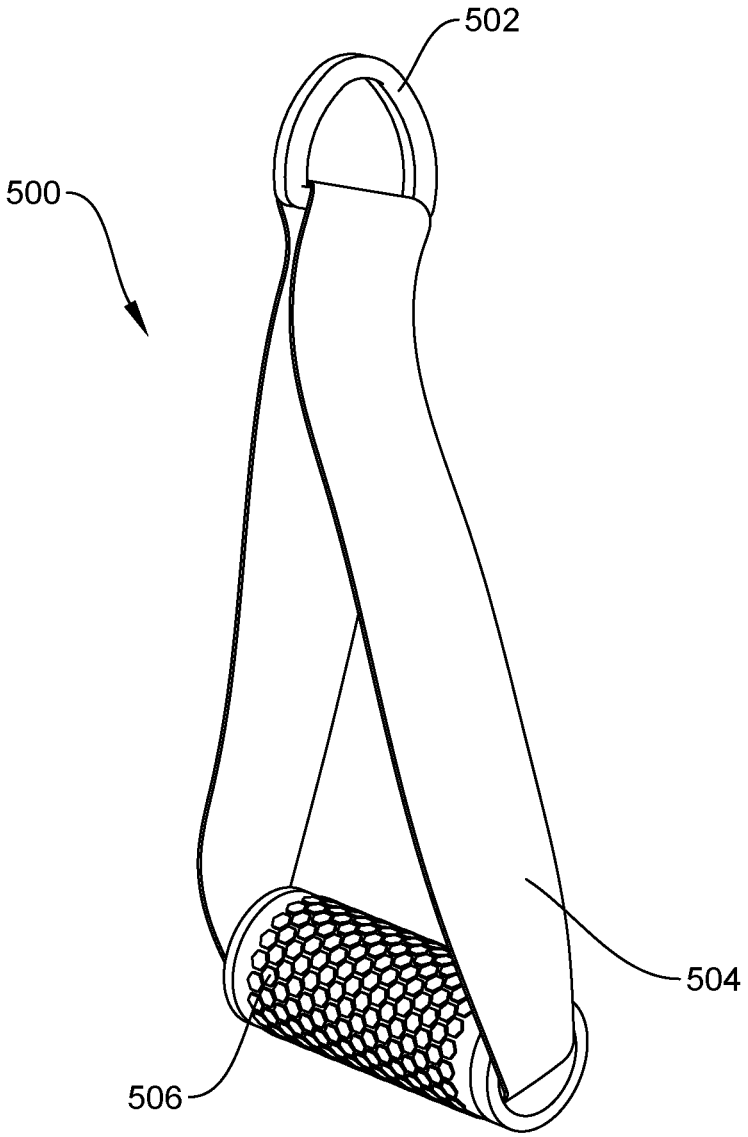
FIG. 5 illustrates a perspective view of one exemplary variation of the removable handle.

Referring now to FIG. 5, one exemplary removable handle 500 is shown and described in detail. The removable handle 500 may comprise at least one ring 502, a garment 504, and a grip 506. The ring 502 may be a D-ring. The garment 504 may be a strong and flexible fabric. The grip 506 may be a rubber grip. The ring 502 and the grip 506 may be held together with the garment 504. A carabiner may be attached to the ring 502.

Figure 6:
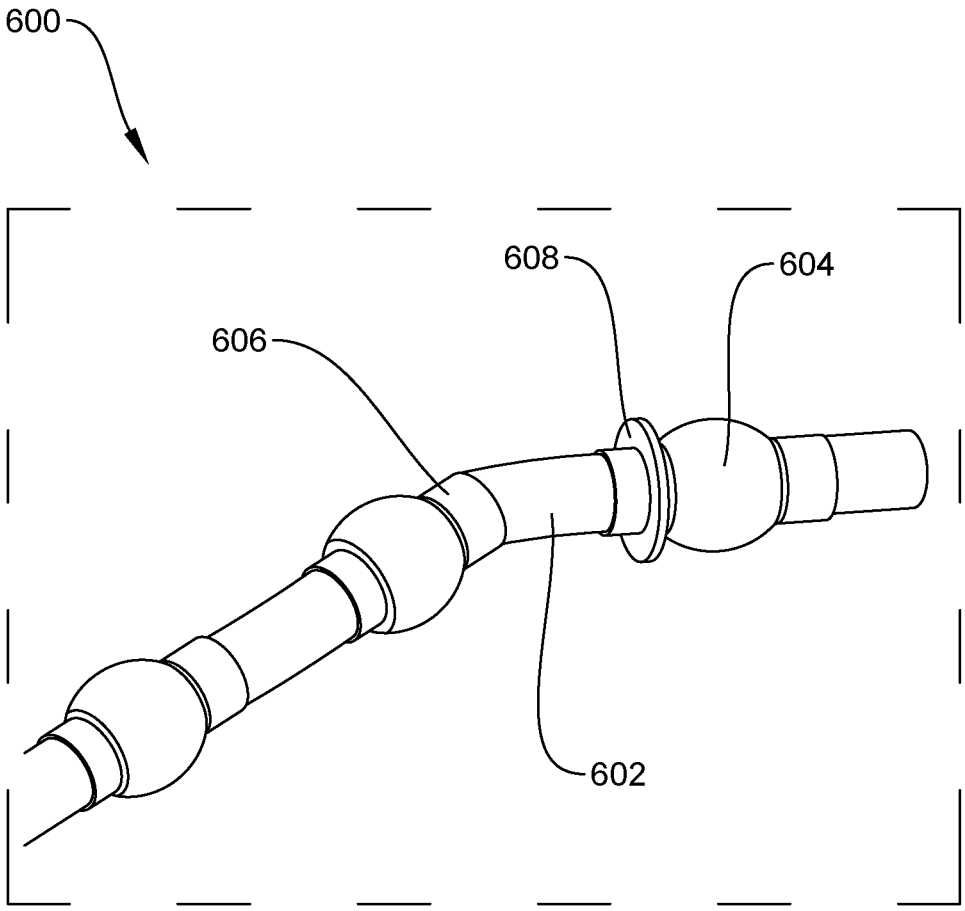
FIG. 6 illustrates a perspective view of one exemplary variation of one portion of the resistance band.

Referring now to FIG. 6, one exemplary resistance band 600 is shown and described in detail. The resistance band 600 may comprise a hollow tube 602, at least one protrusion 604, and at least one elastic cover 606. The hollow tube 602 may be made of an elastic material, including, but not limited to, rubber. The hollow tube 602 may have increasing tension based on how stretched out it is. The protrusions 604 may be created by inserting balls into the rubber tube at pre-determined intervals, wherein the intervals may be positioned as necessary in order to provide a desired intensity and location for the resistance the user will encounter during exercise. The balls must have a greater diameter than the inner diameter of the hollow tube. The elastic cover 606 may enclose the protrusions 604 and a portion of the hollow tube 602 surrounding the protrusions 604. The elastic cover 606 may prevent the balls from moving around within the hollow tube 602. The elastic cover 606 may be made of an elastic material, including, but not limited to, rubber. A washer 608 may located along the hollow tube 602 between a first and second protrusion.

A resistance band 600 may be attached to the portable fitness device by inserting a segment of the hollow tube 602 into an anchor slot and locking in the resistance band 602 by pulling on the resistance band 602 until one protrusion 604 is firmly placed against an anchor slot. The resistance band 600 may offer 10, 20, 30, or 50 pounds of resistance. Each portable fitness device may come with two resistance bands 600 with 10 pounds of resistance, two resistance bands 600 with 20 pounds of resistance, two resistance bands 600 with 30 pounds of resistance, and four resistance bands 600 with 50 pounds of resistance. The resistance bands 600 may provide a required resistance intensity when stretched to 250% of a base length.

The intensity and location of the resistance a user encounters during exercise may be adjusted by changing which protrusion 604 of the resistance band 600 is used to lock the resistance band 600 into an anchor slot. The intensity and location of the resistance a user encounters may be further adjusted by changing the quantity of resistance bands 600 used in the workout. Multiple resistance bands 600 may locked into the anchor slots on the periphery of the first frame or the second frame. A user may work out with between 1-20 resistance bands simultaneously, and most preferably with between 1-8 resistance bands simultaneously.

The resistance bands 600 may have varying resistance properties based on the material used for the hollow tube 602, the thickness of the hollow tube 602, and the number and location of protrusions 604 in the hollow tube 602.

In an exemplary embodiment, a custom hook attaches to the protrusions 604 on the resistance bands 600. The custom hook may be further attached to a carabiner, wherein this carabiner is attached to a D-ring on one end of a steel bar.

A carabiner may be attached to an end of the resistance band 600. The carabiner may be attached to the washer 608. In an exemplary embodiment, the resistance band 600 may be split into 6 loops at 1-inch intervals, with a carabiner on one end. These straps are for making minor adjustments to different exercises.

In order to prepare a resistance band 600, a first rubber clamp may first be clamped at one end of the hollow tube 602. A second rubber clamp may then be clamped at a pre-determined position where a small ball needs to be placed. A small ball may then be inserted through the open end of the hollow tube 602. The small ball may then be pushed, using a pneumatic device, until it reaches the second rubber clamp. This procedure may be repeated until all of the required small balls are placed at their pre-determined positions. An elastic cover 606 may then be expanded using a stretching tool and moved onto a position of a rubber ball. The stretching tools may then be removed and the elastic cover 606 is allowed to contract onto the protrusion 604 caused by the rubber ball, and a portion of the surrounding hollow tube 602. This procedure may be repeated until all protrusions 604 are enclosed in an elastic cover 606. The resistance band 600 may be ready for use once the small balls are inserted at pre-determined intervals and elastic covers 606 are placed over the protrusions 604 caused by the small balls. Any movement between the rubber balls and the hollow tube 602 may be checked as safety measure.

Figure 7:
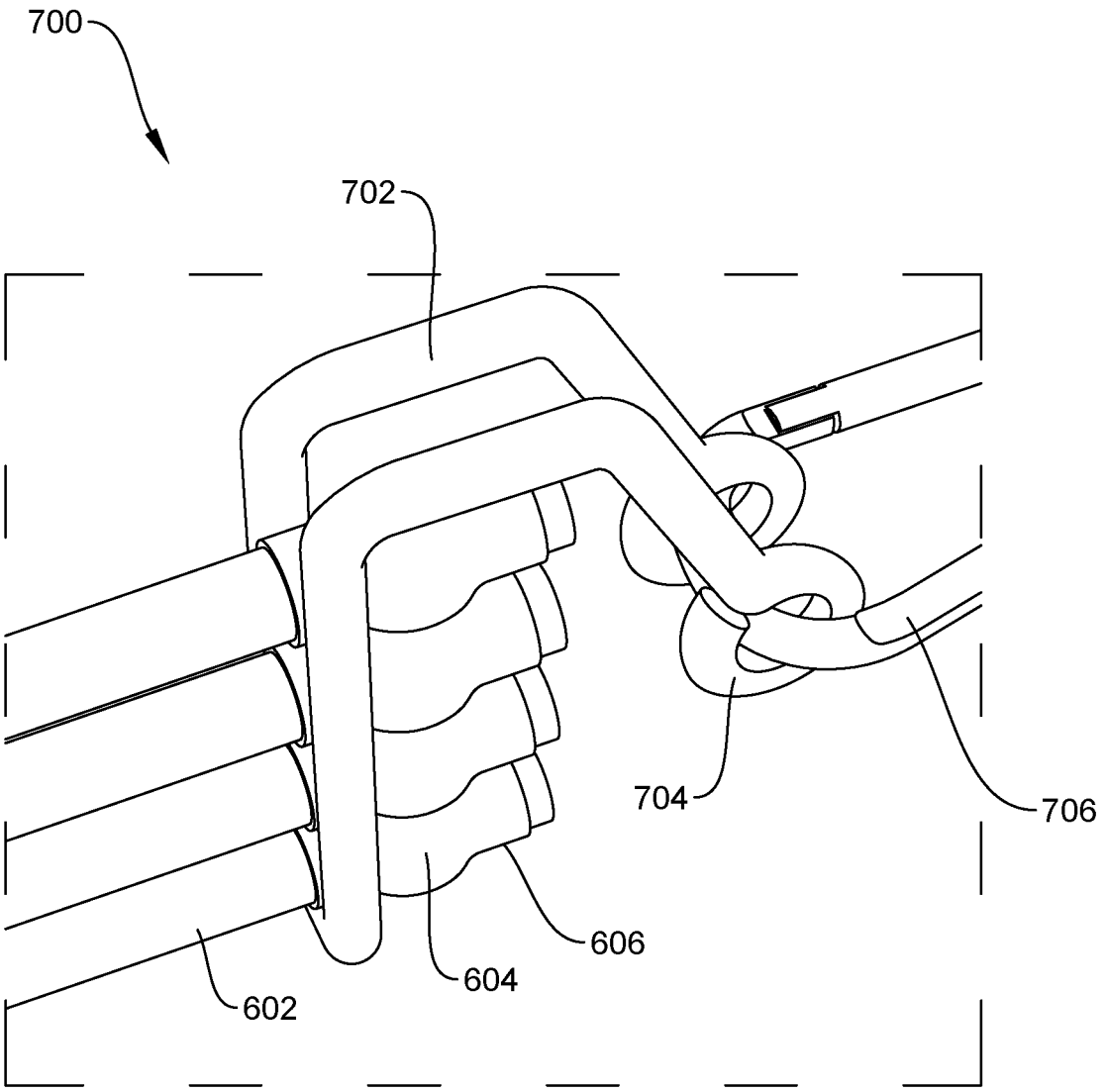
FIG. 7 illustrates a perspective view of one exemplary variation of the custom hook.

Now referring to FIG. 7, one exemplary custom hook 700 is shown and described in detail. The custom hook 700 may comprise a main segment 702 and loop segments 704. The main segment 702 may have a U-shaped end that allows the main segment 702 to lock in up to four resistance bands. The loop segment 704 may have two loop-shaped ends that may allow the attachment of a carabiner 706. The carabiner 706 may be sufficiently large in order to be attached to the loop segment 702 of the custom hook 700. The custom hook 700 may be made of steel and may be black in color.

The present invention further provides means for adapting the workout from a beginner routine to an advanced routine by simply changing the degree of motions used. For example, the degree the user dips their body or raises a limb. Although various adjustable components are contemplated such as a restrictive force pivot assembly and restrictive motion bands, no adjustment to the exercise device is required. The present invention is advantageously adapted for use in a group exercise or class setting much like a step class or aerobic dance class. The small size of the device makes it easy to store multiple units at the facility or gives the user the option of bringing their own device to the class. Beginners can workout alongside advanced users performing moves to the same commands and if desired, to the same music, and at the same time. This advantageously eliminates the need and expense for an exercise facility to offer classes to users with different fitness levels, or even to offer the required equipment as it may be user provided.

The present invention further provides a safe and improved core exercise device that advantageously increases access to core training to a larger population. As most core training is currently performed on the floor, using an exercise ball, or expensive machines found only in gyms, many people cannot perform such exercises. For example, many people are unable to lie on the floor due to excessive weight, weakness, or injury. The elderly and obese are typically precluded from most core training exercises. This present invention, however, may advantageously be used by the obese, elderly, and even those with limited mobility.

While various aspects and embodiments have been disclosed herein, other aspects and embodiments will be apparent to those skilled in the art. The various aspects and embodiments disclosed herein are for purposes of illustration and are not intended to be limiting.

The sections above may set forth one or more but not all exemplary embodiments and thus are not intended to limit the scope of the present disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptation and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Following from the above description summaries, it should be apparent to those of ordinary skill in the art that, while the methods, apparatuses and data structures herein described constitute exemplary embodiments of the current disclosure, it is to be understood that the inventions contained herein are not limited to the above precise embodiments and that changes may be made without departing from the scope of the invention as claimed. Likewise, it is to be understood that it is not necessary to meet any or all of the identified advantages or objects of the invention disclosed herein in order to fall within the scope of the inventions, since inherent and/or unforeseen advantages of the current disclosed embodiments may exist even though they may not have been explicitly discussed herein.

What is claimed is:

1. A portable fitness device comprising:

at least a first frame, at least a second frame, and a hinge wherein the first frame and the second frame are connected using the hinge;

wherein the first frame and the second frame have a top surface and a bottom surface;

anti-slide plates attached to the top surface of at least one of the first frame and the second frame;

at least one resistance band wherein the resistance band comprises a hollow tube made of an elastic material;

wherein the resistance band has a plurality of protrusions that allow the resistance band to be locked into an anchor slot;

wherein the protrusions are caused by balls inserted inside of the hollow tube at pre-determined intervals;

wherein the protrusions and a portion of the hollow tube surrounding the protrusions is enclosed by an elastic cover;

at least one anchor slot integrated into each of the first frame and the second frame wherein the anchor slots allow a user to lock in the resistance band into each anchor slot;

wherein the portable fitness device enables the user to exercise using at least a portion of body weight for resistance while using at least one of the first frame or the second frame for support;

wherein the portable fitness device has an unfolded configuration and a folded configuration;

wherein the bottom surface of the first frame and the bottom surface of the second frame, separated by 180 degrees, are parallel in the unfolded configuration;

wherein the bottom surface of the first frame and the bottom surface of the second frame, separated by 0 degrees, are flush in the folded configuration;

wherein the portable fitness device can be transformed between the unfolded configuration and the folded configuration by rotating the first frame and the second frame around the hinge, folding or unfolding the portable fitness device;

wherein the portable fitness device can be used as a carrying case while the portable fitness device is in the folded configuration; and wherein the portable fitness device has at least one cavity that secures at least one fitness accessory when the portable fitness device is in the closed configuration.

2. The portable fitness device as in claim 1 wherein the hollow tube comprises 2-14 protrusions, preferably 4-12 protrusions, more preferably 6-10 protrusions, and most preferably 8 protrusions;

wherein the protrusions are positioned at pre-determined intervals; and wherein intensity and location of resistance is determined by which protrusion is locked into the anchor slot, allowing for multiple exercise options.

3. The portable fitness device as in claim 2 wherein the resistance band further comprises a washer between a first protrusion and a second protrusion.

* * * * *